US010684085B2

(12) United States Patent
Leitner-Wise

(10) Patent No.: US 10,684,085 B2
(45) Date of Patent: Jun. 16, 2020

(54) QUICK RELEASE GAS BLOCK SECURING SYSTEM

(71) Applicant: Paul Leitner-Wise, Alexandria, VA (US)

(72) Inventor: Paul Leitner-Wise, Alexandria, VA (US)

( * ) Notice: Subject to any disclaimer, the term of this patent is extended or adjusted under 35 U.S.C. 154(b) by 2 days.

(21) Appl. No.: 16/181,187

(22) Filed: Nov. 5, 2018

(65) Prior Publication Data

US 2019/0170461 A1 Jun. 6, 2019

Related U.S. Application Data

(60) Provisional application No. 62/583,440, filed on Nov. 8, 2017.

(51) Int. Cl.

| | |
|---|---|
| ***F41A 5/26*** | (2006.01) |
| ***F41A 5/28*** | (2006.01) |
| ***F41A 11/00*** | (2006.01) |
| *F41A 5/24* | (2006.01) |
| *F41A 5/20* | (2006.01) |

(52) U.S. Cl.

CPC ..... *F41A 5/28* (2013.01); *F41A 5/26* (2013.01); *F41A 11/00* (2013.01); *F41A 5/20* (2013.01); *F41A 5/24* (2013.01)

(58) Field of Classification Search

CPC ..... F41A 5/28; F41A 5/26; F41A 5/20; F41A 5/24; F41A 5/18; F41A 11/00; F41A 3/12; F41A 3/66

USPC ..... 89/193, 191.01, 192; 42/75.01

See application file for complete search history.

(56) References Cited

U.S. PATENT DOCUMENTS

| | | | | |
|---|---|---|---|---|
| 5,824,943 | A * | 10/1998 | Guhring | F41A 5/26 89/192 |
| 5,945,626 | A | 8/1999 | Robbins | |
| 8,109,194 | B2 | 2/2012 | Stone | |
| 8,443,711 | B2 | 5/2013 | Clark et al. | |
| 9,417,020 | B2 | 8/2016 | McGinty | |
| 9,541,339 | B2 | 1/2017 | Orne, III et al. | |
| 9,714,802 | B1 | 7/2017 | Storch | |
| 2006/0277810 | A1* | 12/2006 | Leitner-Wise | F41A 3/66 42/75.03 |
| 2008/0092733 | A1* | 4/2008 | Leitner-Wise | F41A 3/26 89/138 |
| 2008/0276797 | A1* | 11/2008 | Leitner-Wise | F41A 3/12 89/191.01 |
| 2008/0282595 | A1* | 11/2008 | Clark | F41A 17/06 42/1.01 |
| 2009/0277065 | A1* | 11/2009 | Clark | F41A 19/01 42/1.03 |
| 2011/0179945 | A1* | 7/2011 | Clark | F41A 5/18 89/193 |
| 2012/0167757 | A1* | 7/2012 | Gomez | F41G 1/02 89/193 |
| 2015/0204627 | A1* | 7/2015 | Gomez | F41A 5/28 89/193 |
| 2016/0084598 | A1* | 3/2016 | Gomez | F41A 5/28 89/193 |

* cited by examiner

*Primary Examiner* — Michael D David

(57) ABSTRACT

A quick release gas block securing system is provided. The quick release gas block securing system quickly secures the gas block and a gas nozzle attached thereto to a rifle barrel, and conversely, quickly releases the gas block and gas nozzle attached thereto from the rifle barrel.

10 Claims, 16 Drawing Sheets

SECTION A-A

SECTION B-B

| # | Description of Part # |
|---|---|
| 100 | a rifle barrel 100 |
| 106 | bore 106 of rifle barrel 100 |
| 120 | longitudinal axis 120 of the rifle barrel 100 |
| 130 | an upper exterior surface 130 of the rifle barrel 100 |
| 140 | a lower exterior surface 140 of the rifle barrel 100 |
| 143 | a blind hole 143 |
| 145 | an index pin 145 |
| 147 | gas port 147 |
| 150 | a rod guide ring 150 |
| 160 | a recess 160 in the lower exterior surface 140 |
| 180 | a gas block 180 |
| 200 | a gas block longitudinal axis 200 |
| 220 | an upper section 220 of gas block 180 |
| 230 | a cylindrical cavity 230 |
| 240 | a lower section 240 of gas block 180 |
| 250 | a distal end 250 of a gas nozzle 260 |
| 260 | a gas nozzle 260 |
| 270 | a gas nozzle securing pin 270 |
| 275 | a vertical bore 275 |
| 290 | top 290 of the gas block 180 |
| 295 | through bore 295 |
| 310 | a horizontal through bore 310 |
| 312 | a slot 312 |
| 315 | an internal upper surface 315 |
| 325 | a gas propellant passage 325 |
| 330 | an expansion chamber 330 |
| 332 | an operating rod mechanism 332 |
| 340 | a first horizontal bore 340 |
| 360 | an upper side 360 of the first horizontal bore 340 |
| 380 | a first horizontal release pin 380 |
| 380b | a first horizontal release pin with one recess 440 |
| 400 | a first end 400 of first horizontal release pin 380 |
| 410 | a head 410 |
| 420 | a second end 420 of first horizontal release pin 380 |
| 440 | a first recess 440 of the first horizontal release pin 380 |
| 460 | a second recess 460 of the first horizontal release pin 380 |
| 480 | a flat region 480 |
| 500 | a second horizontal bore 500 in the lower section 240 |
| 520 | a second horizontal release pin 520 inside the second horizontal bore 500 |
| 540 | a first end 540 of the second horizontal release pin 520 |
| 560 | a second end 560 of the second horizontal release pin 520 |
| 580 | a set screw 580 |
| 600 | a spring 600 |

*FIG. 10*

QUICK RELEASE GAS BLOCK SECURING SYSTEM

CROSS REFERENCE TO RELATED APPLICATIONS

This application claims the benefit of U.S. Application No. 62/583,440, filed Nov. 8, 2017, the content of which is incorporated herein by reference in its entirety.

STATEMENT REGARDING FEDERALLY SPONSORED RESEARCH OR DEVELOPMENT

Not Applicable.

FIELD OF THE INVENTION

The present invention relates generally to gas block securing and release systems.

BACKGROUND OF THE INVENTION

Semi-automatic firearms, such as AR-15 type rifles, and shotguns, are designed to fire a round of ammunition, such as a cartridge or shot shell, in response to each squeeze of the trigger of the firearm, and thereafter automatically load the next shell or cartridge from the firearm magazine into the chamber of the firearm. During firing, the primer of the round of ammunition ignites the propellant inside the round, producing an expanding column of high pressure gases within the chamber and barrel of the firearm. The force of this expanding gas propels the bullet/shot of the cartridge or shell down the barrel.

In semi-automatic rifles and shotguns, a portion of the expanding gases typically are directed through a duct or port that interconnects the barrel of the firearm to a piston assembly that generally houses an axially moveable piston. This piston assembly further typically includes a gas block that connects the piston assembly to the barrel, and through which the explosive gases pass. There is a need for an efficient gas block securing and release system.

SUMMARY

A quick release gas block securing system is provided. The quick release gas block securing system quickly secures the gas block and a gas nozzle attached thereto to a rifle barrel, and conversely, quickly releases the gas block and gas nozzle attached thereto from the rifle barrel.

BRIEF DESCRIPTION OF THE DRAWINGS

FIG. 10 shows a table of parts according to the invention.

DETAILED DESCRIPTION OF THE PREFERRED EMBODIMENTS OF THE INVENTION

Figure 1A:
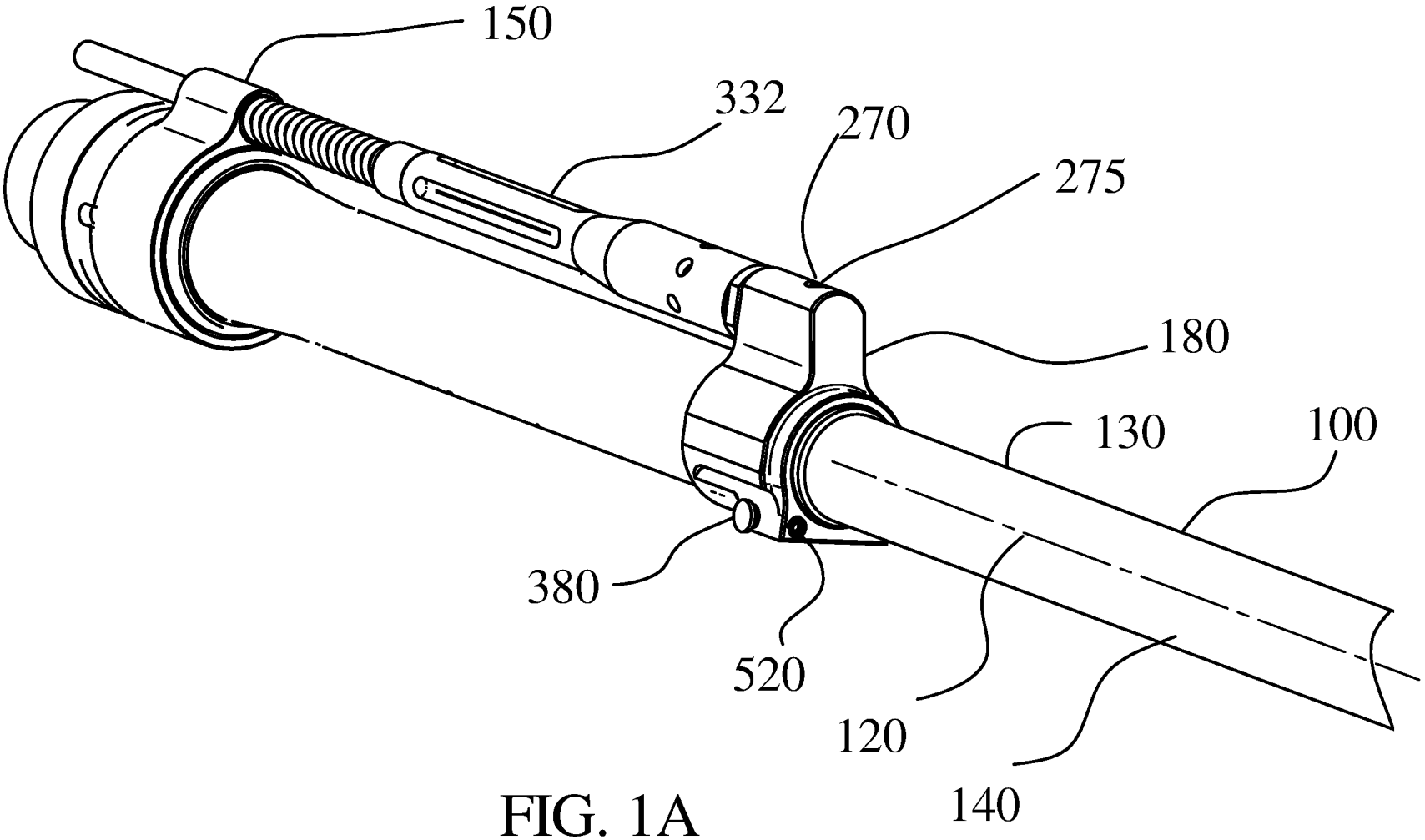
FIGS. 1A and 1B each show a perspective environmental view of a gas block according to the present invention.
Figure 1B:
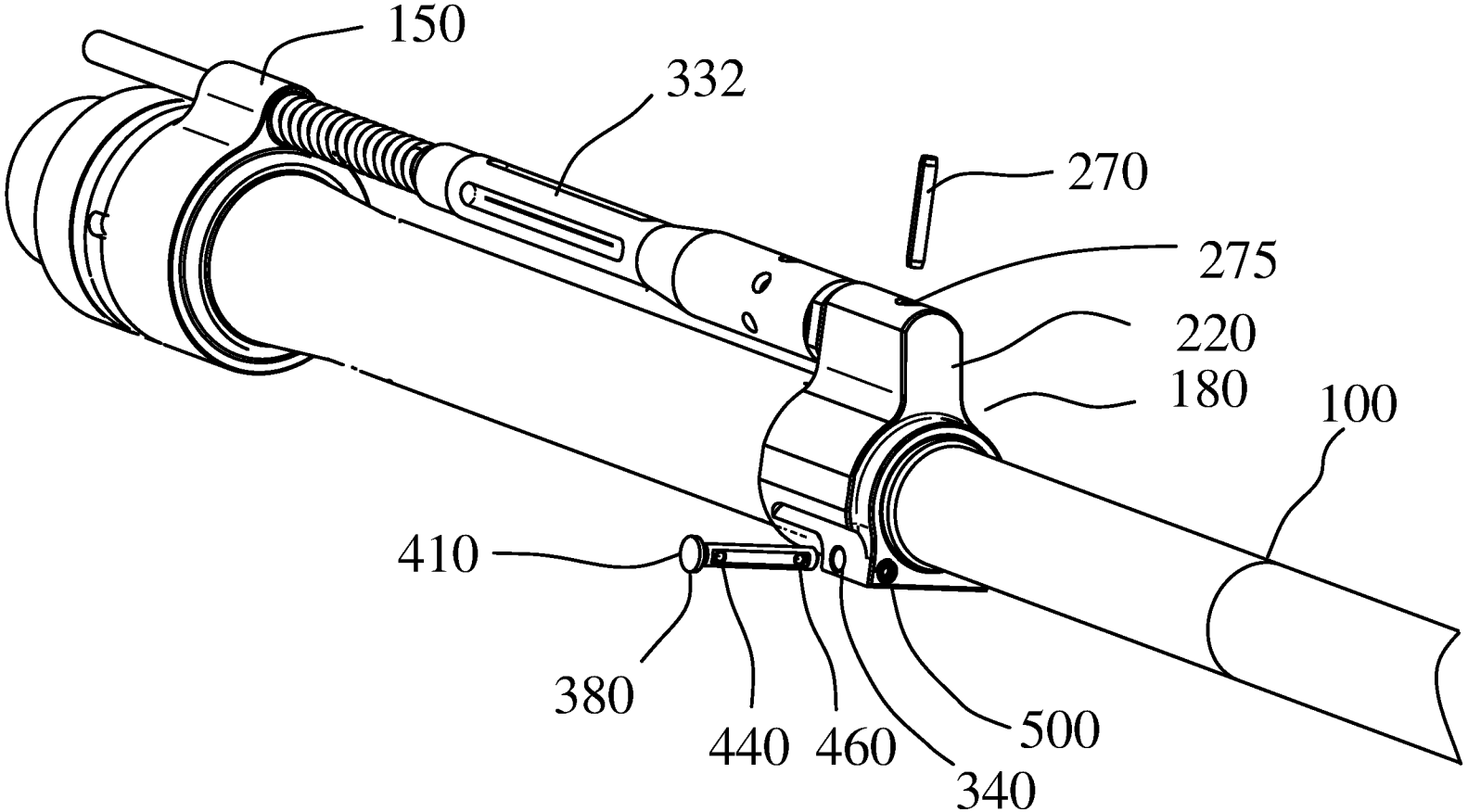
Figure 2A:
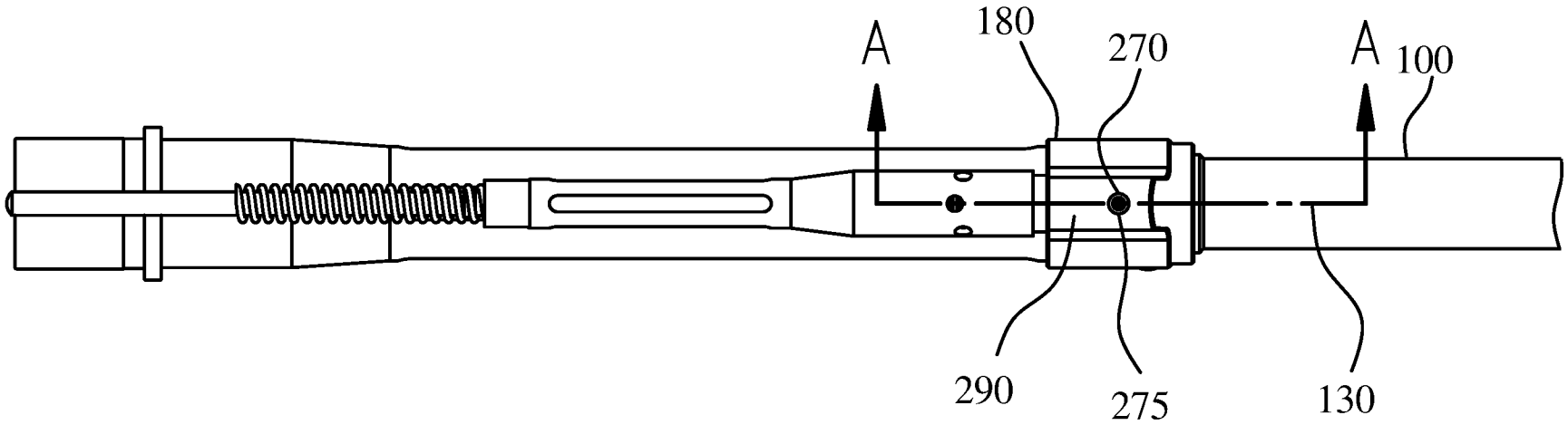
FIG. 2A shows a top view of the gas block shown in FIG. 1A.
Figure 2B:
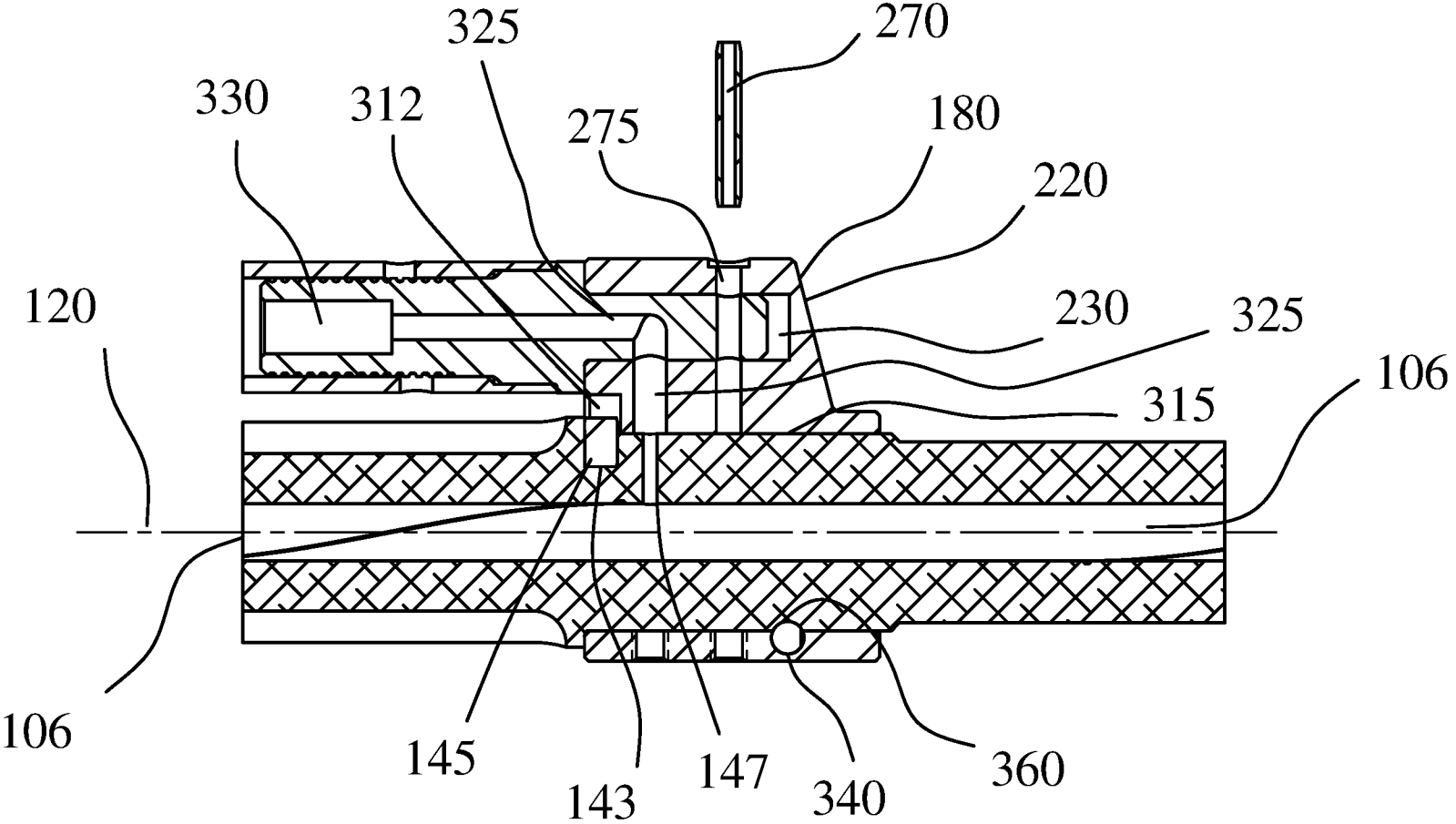
FIG. 2B is a cross-sectional view along line A-A of FIG. 2A.
Figure 3A:
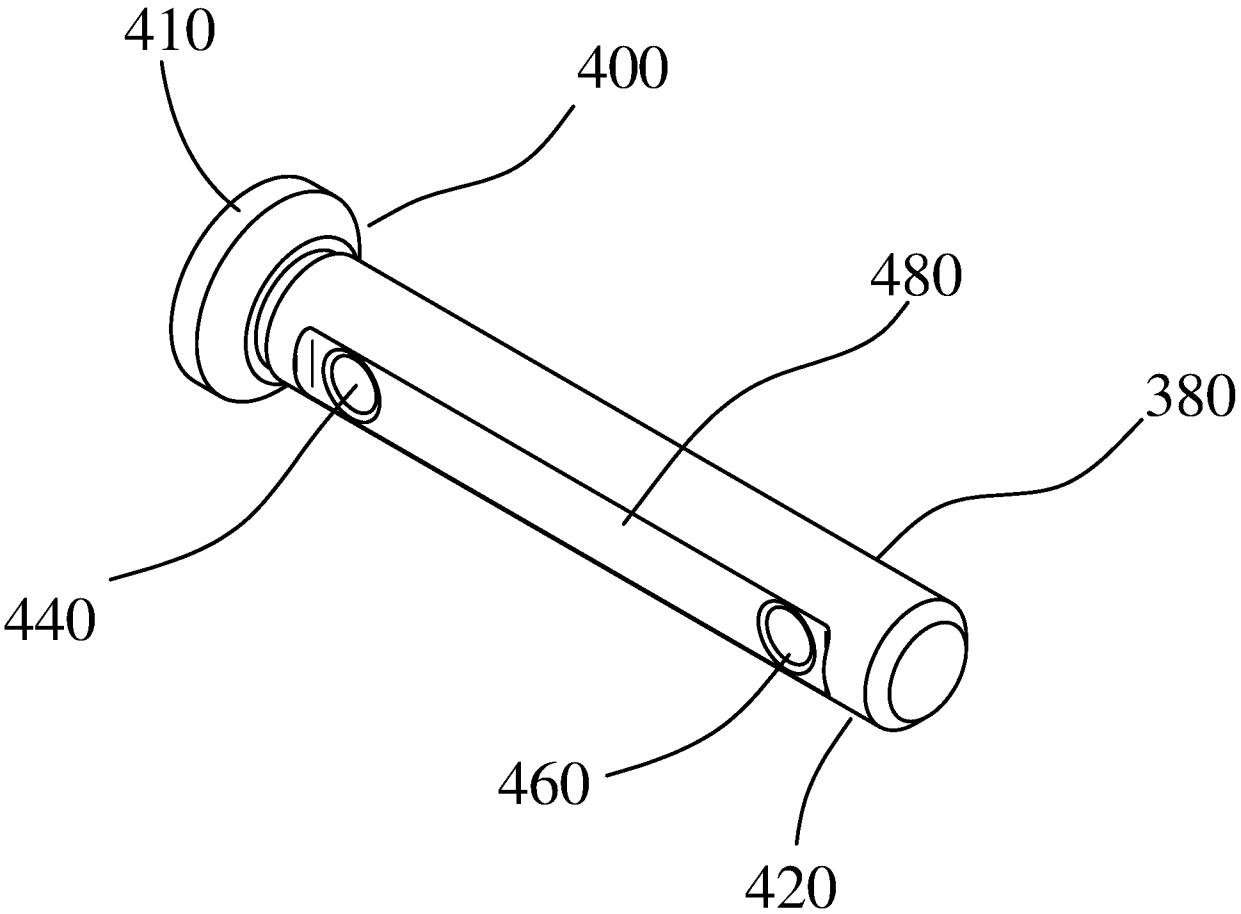
FIGS. 3A through 3C show views of a first horizontal release pin with first and second recesses.
Figure 3B:
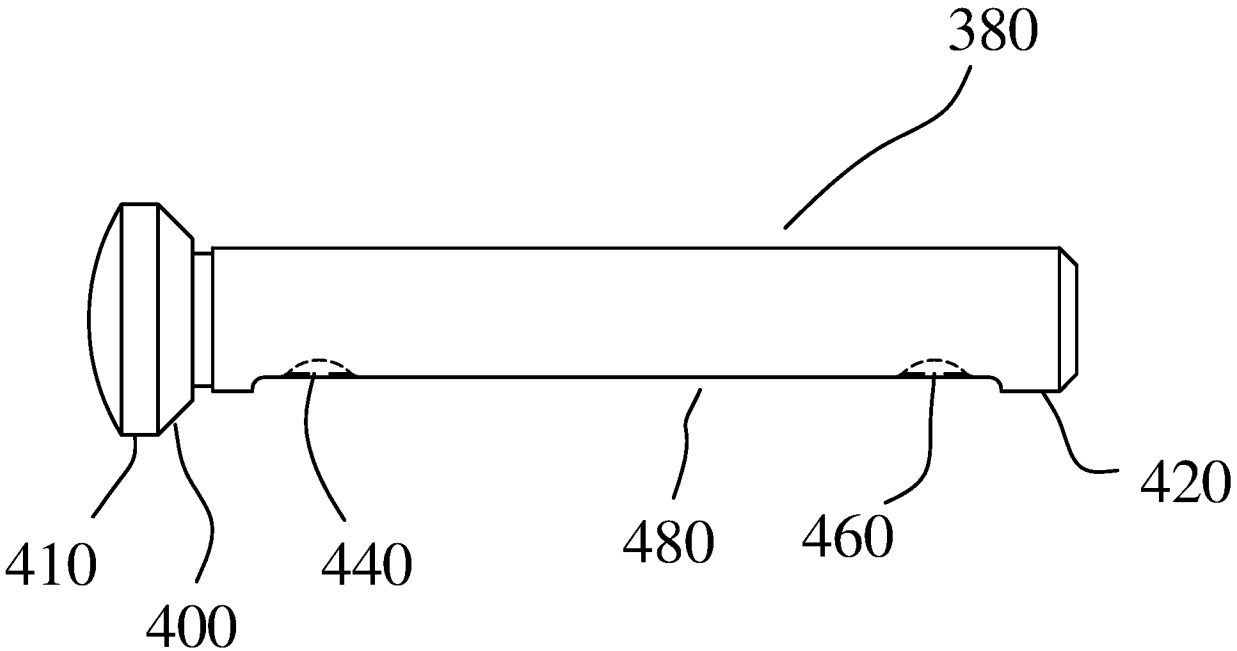
Figure 3C:
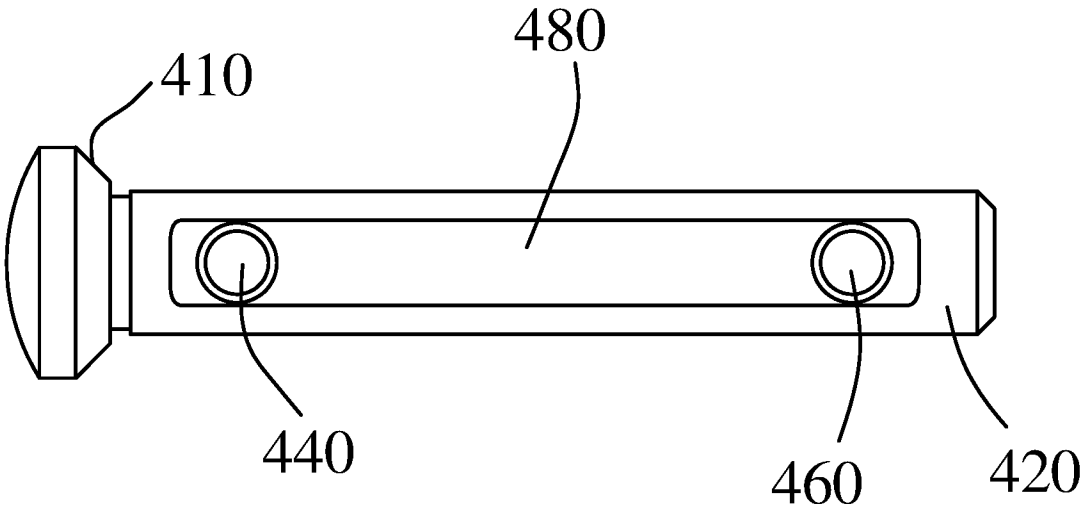

A quick release gas block securing system is provided. The quick release gas block securing system quickly secures the gas block and a gas nozzle attached thereto to a rifle barrel, and conversely, quickly releases the gas block and gas nozzle attached thereto from the rifle barrel.

Referring to the Figures in general, Table 1 (FIG. 10) is a useful point of reference. The quick release gas block securing system of the present invention comprises a rifle barrel 100. The rifle barrel 100 includes a longitudinal axis 120, an upper exterior surface 130, and a lower exterior surface 140. The upper exterior surface 130 has a blind hole 143 therein and a gas port 147. The blind hole 143 receives an index pin 145 by friction fit. The gas port 147 directs propellant gas from a bore 106 into a gas block 180. The lower exterior surface 140 has an external recess 160. The external recess 160 is transverse with respect to the lower exterior surface 140 of the rifle barrel 100.

The gas block 180 comprises a gas block longitudinal axis 200, an upper section 220 and a lower section 240. The upper section 220 includes a cylindrical cavity 230 for receiving a distal end 250 of a gas nozzle 260. The gas nozzle 260 is held securely in place by a gas nozzle securing pin 270. The gas nozzle securing pin 270 extends into a vertical bore 275. In more detail, the gas nozzle securing pin 270 extends through the top 290 of the gas block 180 into a through bore 295 in the distal end 250 of the gas nozzle 260.

The lower section 240 of gas bock 180 includes a horizontal through bore 310 of sufficient diameter to receive the rifle barrel 100. The through bore 310 has an internal upper surface 315 and a gas propellant passage 325 leading from the internal upper surface 315 for directing propellant gas received from gas port 147 of the rifle barrel 100 through the upper section 220 to and through the gas nozzle 260 to an expansion chamber 330 and thence to an operating rod mechanism 332.

The lower section 240 of the gas block 180 further comprises a first horizontal bore 340. The first horizontal bore 340 is aligned with and in direct communication with the recess 160 in the lower exterior surface 140 of the rifle barrel 100. The recess 160 in the lower exterior surface 140 of the rifle barrel 100 extends at least part way along an upper side 360 of the first horizontal bore 340.

A first horizontal release pin 380 is dimensioned to slidably engage the first horizontal bore 340. The first horizontal release pin 380 has a first end 400 and a second end 420. The first end 400 thereof defining a head 410. The first horizontal release pin 380 having a first recess 440 and a second recess 460 respectively located proximate to the first and second ends 400 and 420 of the first horizontal release pin 380. The first and second recesses 440 and 460 of the first horizontal release pin 380 are aligned with respect to each other. The first horizontal release pin 380 has a flat region 480 extending between the first and second recesses 440 and 460 of the first horizontal release pin 380. Upon full insertion of the first release pin 380 in the first horizontal bore 340 the first horizontal release pin 380 engages with the recess 160 in the lower exterior surface 140 of the rifle barrel 100.

The lower section 240 of the gas block 180 has a second horizontal bore 500 and a second horizontal release pin 520 inside the second horizontal bore 500. The second horizontal bore 500 and the second horizontal release pin 520 are perpendicular to the first horizontal bore 340 and in contact therewith. The second horizontal bore 500 is parallel to the longitudinal axis 200 of the gas block 180. Upon full insertion of the first horizontal release pin 380 into the first horizontal bore 340 the first recess 440 of the first horizontal release pin 380 is manually alignable with the respect to the second horizontal bore 500 and the second horizontal release pin 520 therein.

During normal use the first horizontal release pin 380 is movable between a first and a second position inside the first horizontal bore 340. At the first position the first recess 440 of the first horizontal release pin 380 is secured by a first end 540 of the second horizontal release pin 520 such that the first horizontal release pin 380 engages with the recess 160 in the lower exterior surface 140 of the rifle barrel 100 thereby securing the gas block 180, and the gas nozzle 260 attached thereto, to the rifle barrel 100. At the second position the second recess 460 of the first horizontal release pin 380 is secured by the first end 540 of the second horizontal release pin 520 such that the first horizontal release pin 380 does not engage with the recess 160 in the lower exterior surface 140 of the rifle barrel 100 thereby releasing the gas block 180 and the gas nozzle 260 attached thereto from the rifle barrel 100. The advantage of achieving a second position is that the first horizontal release pin 380 is prevented from exiting the first horizontal bore 340. The flat region 480 acts as a slidable guide with respect to the first end 540 of the second horizontal release pin 520.

The second horizontal release pin 520 defines a second end 560. The second end 560 defines a set screw 580. The set screw 580 encloses a spring 600. The spring 600 biases the second horizontal release pin 520 to engage first recess 440 of first horizontal release pin 380 or 380*b* (discussed below), or second recess 460 of the first horizontal release pin 380.

Figure 4:
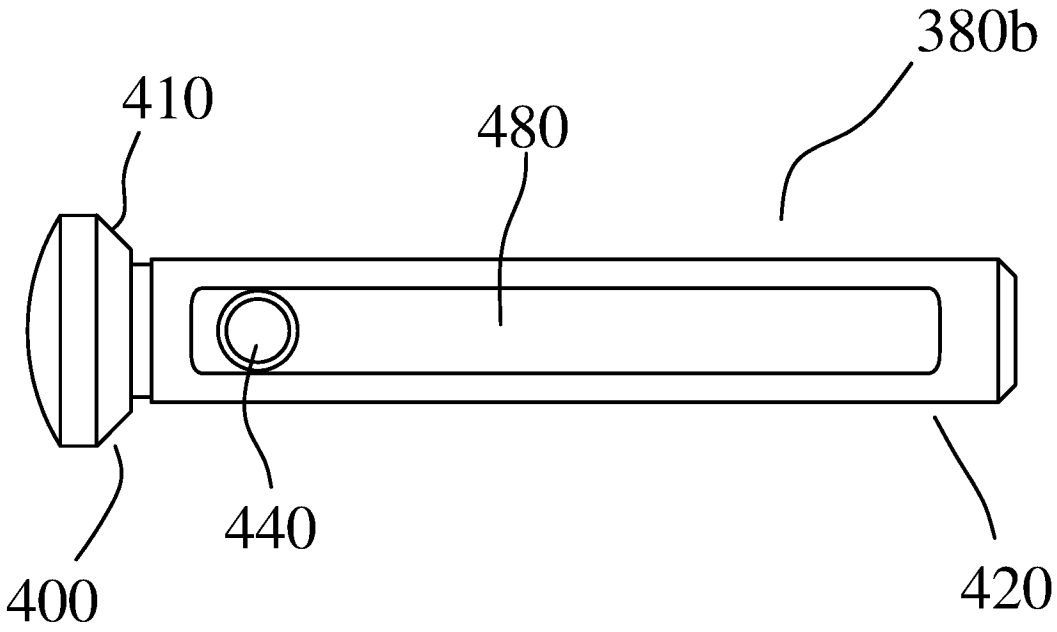
FIG. 4 shows a view of a first horizontal release pin with a single recess.
Figure 5:
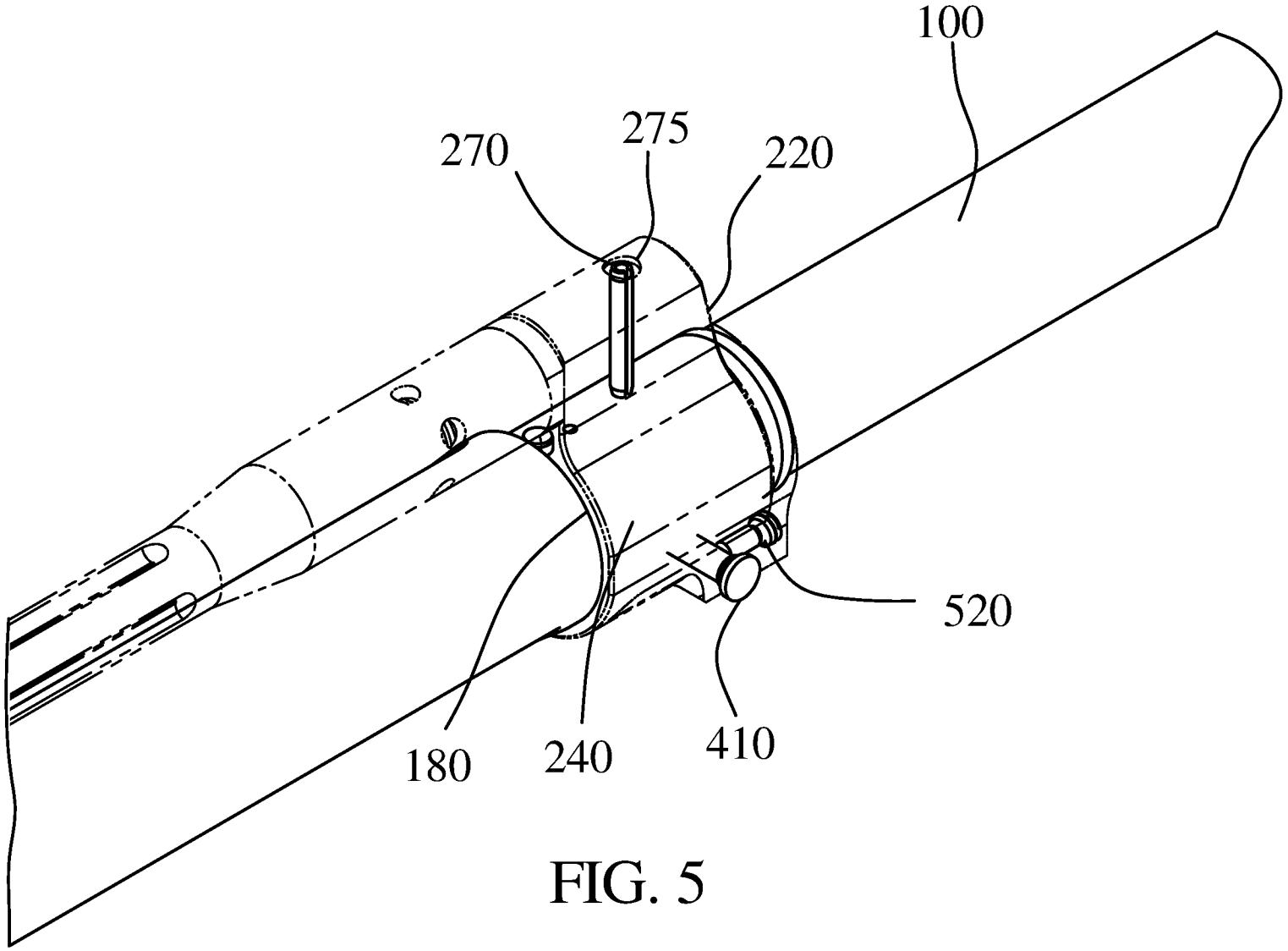
FIG. 5 shows a perspective environmental view of a gas block according to the present invention.
Figure 6A:
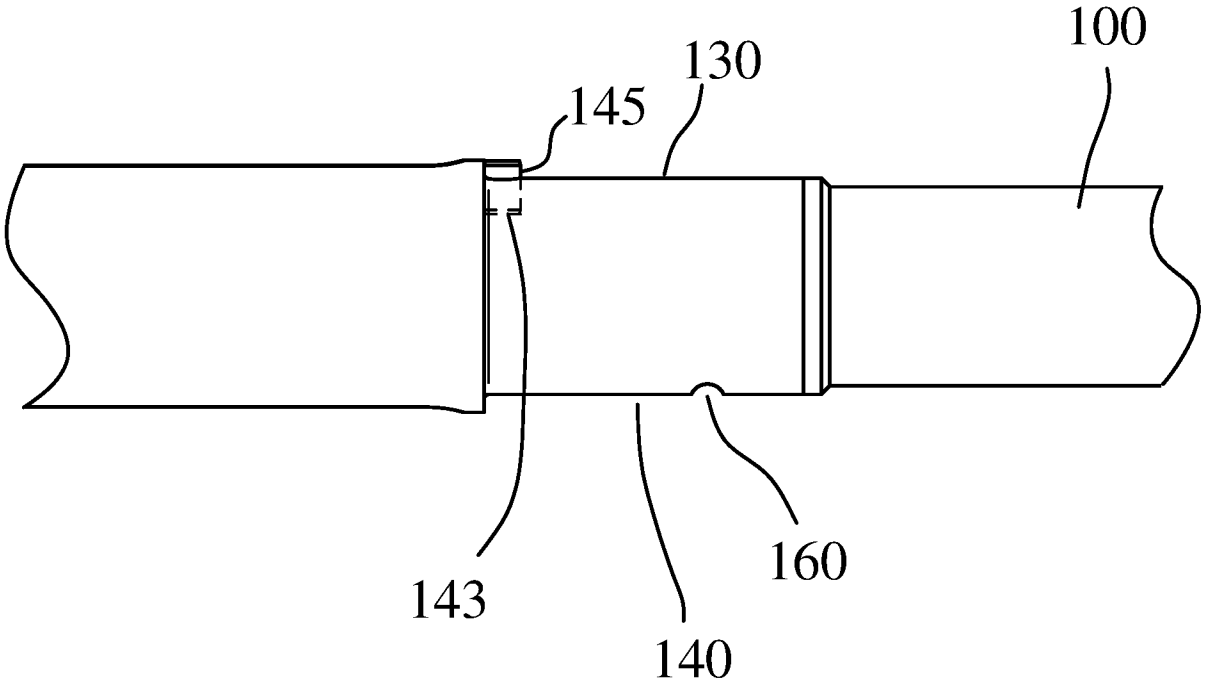
FIG. 6A shows a side view of a rifle barrel according to the invention.
Figure 6B:
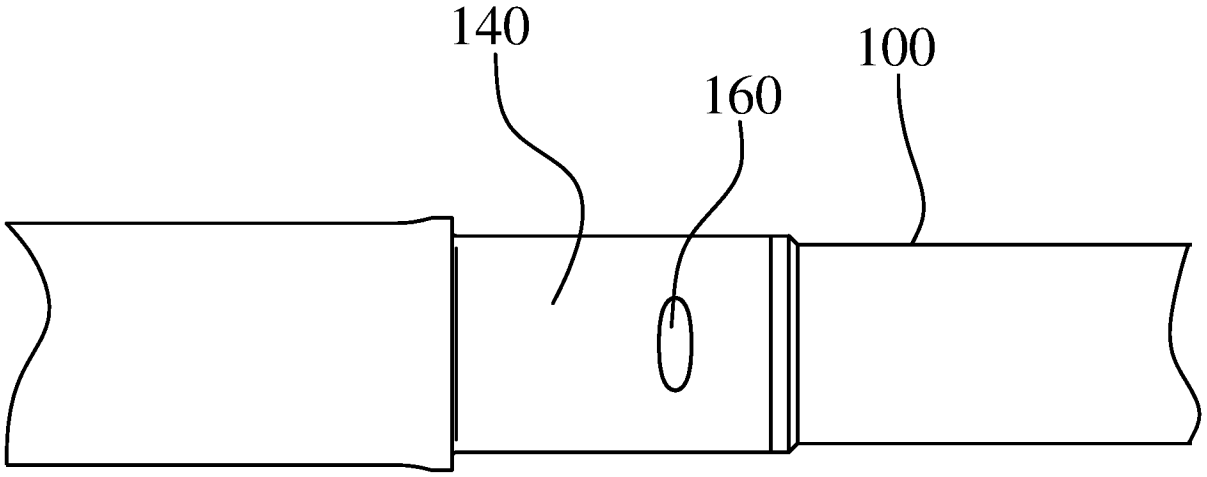
FIG. 6B shows a bottom view of the rifle barrel of FIG. 6A.
Figure 7:
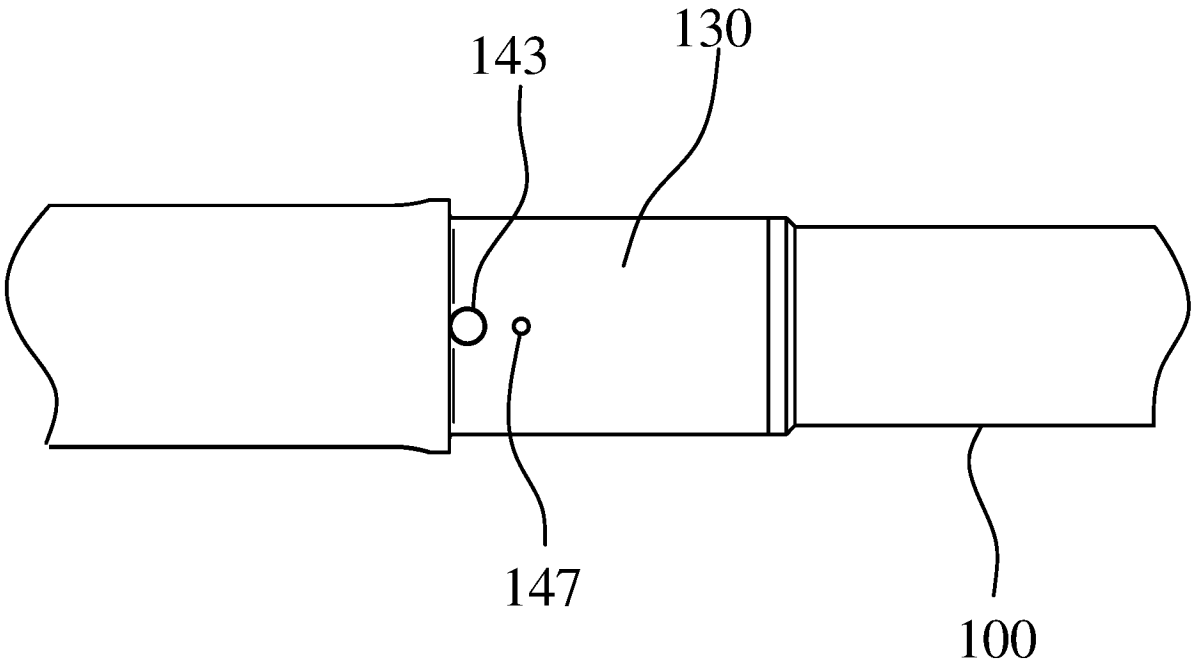
FIG. 7 shows a top view of the rifle barrel of FIG. 6A.
Figure 8A:
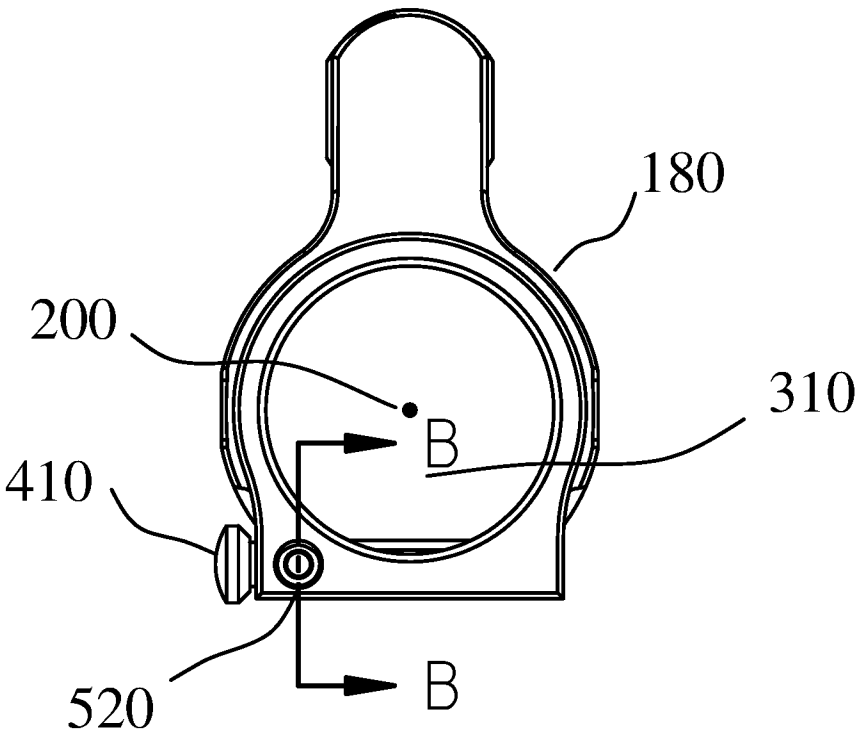
FIG. 8A shows a front end view of the gas block of FIG. 1A.
Figure 8B:
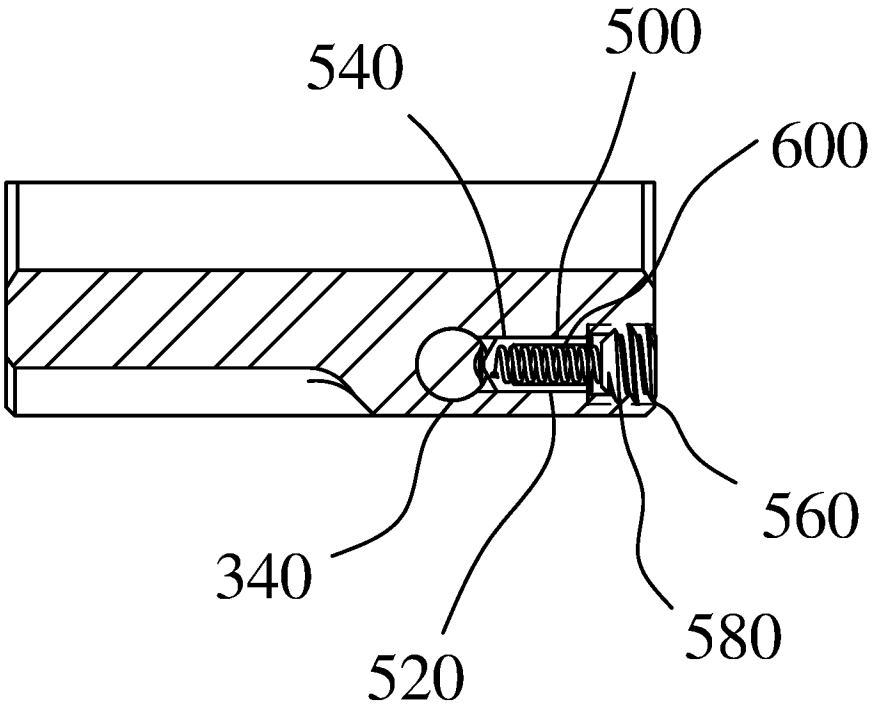
FIG. 8B is a cross-sectional view along line B-B of FIG. 8A.
Figure 9:
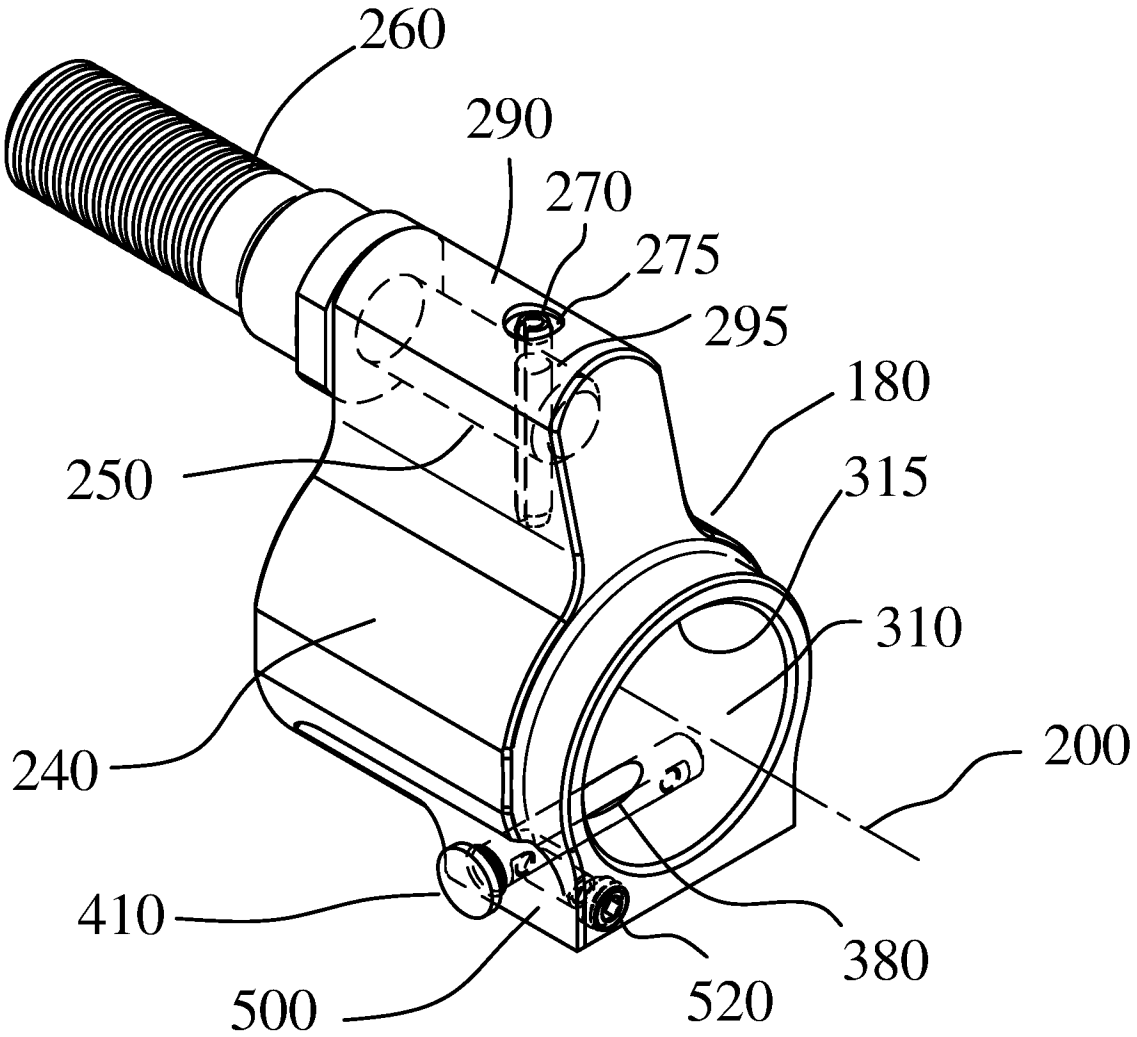
FIG. 9 shows a perspective view of the gas block of FIG. 1A.

The number of recesses in the first horizontal release pin 380 can vary, i.e., the number of recesses number at least one. For example, the first horizontal release pin shown in FIG. 4 (labeled 380*b*) has one recess 440. In this case, the first position can be achieved. Specifically, at the first position the first recess 440 of the first horizontal release pin 380 is secured by a first end 540 of the second horizontal release pin 520 such that the first horizontal release pin 380 engages with the recess 160 in the lower exterior surface 140 of the rifle barrel 100 thereby securing the gas block 180, and the gas nozzle 260 attached thereto, to the rifle barrel 100. In this specific example, due to the lack of second recess 460 the first horizontal release pin 380*b* is not specifically prevented from exiting the first horizontal bore 340. Hence, in this example the first horizontal release pin 380*b* can be lost.

A slot 312 is provided in the internal upper surface 315 at the proximal end of through bore 310 for receiving index pin 145. The index pin 145 prevents rotation of the gas block 180 about longitudinal axis 120 of the rifle barrel 100 and prevents movement of the gas block 180 in a rearward direction beyond index pin 145. The index pin 145 does not prevent forward movement of the gas block 180. Instead, forward movement is prevented by first horizontal release pin 380 while in its first position. Once the first horizontal release pin 380 is not in its first position, and hence the first horizontal release position is not engaged with recess 160 in the lower exterior surface 140 then the gas block 180, and attached gas nozzle 260 is released from the rifle barrel 100 by manually sliding the gas block 180, and attached gas nozzle 260, in a forward direction away from index pin 145.

It is to be understood that the present invention is not limited to the embodiments described above, but encompasses any and all embodiments within the scope of the following claims.

What is claimed:

1. A quick release gas block securing system, comprising:

a rifle barrel 100 comprising a lower exterior surface 140, a longitudinal axis 120 and a bore 106;

a gas block 180 surrounding part of the rifle barrel 100, the gas block 180 comprising a longitudinal axis 200 and a lower section 240;

a means for directing propellant gas from the bore 106 into the gas block 180 and thence out of the gas block 180;

a means for preventing rotation of the gas block 180 about longitudinal axis 120 of the rifle barrel 100; and a means for securing the lower exterior surface 140 of the rifle 100 to the lower section 240 of the gas block 180.

2. The quick release gas block securing system according to claim 1, wherein the lower section 240 of the gas block 180 comprises a first horizontal bore 340 at a perpendicular angle with respect to the gas block longitudinal axis 200, wherein the first horizontal bore 340 is aligned and in direct communication with a recess 160 in the lower exterior surface 140 of the rifle barrel 100, the external recess 160 being transverse with respect to the lower exterior surface 140 of the rifle barrel 100, wherein the recess 160 in the lower exterior surface 140 of the rifle barrel 100 extends at least part way along an upper side 360 of the first horizontal bore 340, wherein a first horizontal release pin 380 is dimensioned to slidably engage the first horizontal bore 340, wherein upon full insertion of the first release pin 380 in the first horizontal bore 340 the first horizontal release pin 380 engages with the recess 160 in the lower exterior surface 140 of the rifle barrel 100, and wherein the lower section 240 of the gas block 180 has a second horizontal bore 500 and a second horizontal release pin 520 located inside the second horizontal bore 500, the second horizontal bore 500 and the second horizontal release pin 520 are perpendicular to the first horizontal bore 340 and in contact therewith.

3. A quick release gas block securing system, comprising:

a rifle barrel 100 comprising a longitudinal axis 120, an upper exterior surface 130, a lower exterior surface 140, the upper exterior surface having a blind hole 143 therein for receiving an index pin 145 and a gas port 147 for directing propellant gas into a gas block 180, the lower exterior surface 140 having an external recess 160, the external recess 160 being transverse with respect to the lower exterior surface 140 of the rifle barrel 100;

wherein the gas block 180 comprises a gas block longitudinal axis 200, an upper section 220 and a lower section 240, the upper section 220 having a cylindrical cavity 230 for receiving a distal end 250 of a gas nozzle 260, the gas nozzle 260 is held securely in place by a gas nozzle securing pin 270 extending into a vertical bore 275 itself extending through a top 290 of the gas block 180 into a through bore 295 in the distal end 250 of the gas nozzle 260;

wherein the lower section 240 of gas block 180 comprises a horizontal through bore 310 of sufficient diameter to receive the rifle barrel 100, the through bore 310 having an internal upper surface 315 and a gas propellant passage 325 leading from the internal upper surface 315 for directing propellant gas received from gas port 147 of the rifle barrel 100 through the upper section 220 to and through the gas nozzle 260 to an expansion chamber 330 and thence to an operating rod mechanism 332, a slot 312 is located in the internal upper surface 315 at the proximal end of gas block 180, the slot 312 is sized to accommodate index pin 145, wherein the lower section 240 of the gas block 180 further comprises a first horizontal bore 340 at a perpendicular angle with respect to the gas block longitudinal axis 200, wherein the first horizontal bore 340 is aligned and in direct communication with the recess 160 in the lower exterior surface 140 of the rifle barrel 100, wherein the recess 160 in the lower exterior surface 140 of the rifle barrel 100 extends at least part way along an upper side 360 of the first horizontal bore 340, a first horizontal release pin 380 is dimensioned to slidably engage the first horizontal bore 340, wherein upon full insertion of the first release pin 380 in the first horizontal bore 340 the first horizontal release pin 380 engages with the recess 160 in the lower exterior surface 140 of the rifle barrel 100, wherein the lower section 240 of the gas block 180 has a second horizontal bore 500 and a second horizontal release pin 520 located inside the second horizontal bore 500, the second horizontal bore 500 and the second horizontal release pin 520 are perpendicular to the first horizontal bore 340 and in contact therewith.

4. The quick release gas block securing system of claim 3, wherein the second horizontal bore 500 is parallel with respect to the longitudinal axis 200 of the gas block 180, whereupon full insertion of the first horizontal release pin 380 into the first horizontal bore 340 the first recess 440 of the first horizontal release pin 380 is manually alignable with the respect to the second horizontal bore 500 and the second horizontal release pin 520 therein.

5. The quick release gas block securing system of claim 3, wherein the first horizontal release pin 380 defines a first end 400 and a second end 420, the first end 400 thereof defining a head 410, the first horizontal release pin 380 having a first recess 440 and a second recess 460 respectively located proximate to the first and second ends 400 and 420 of the first horizontal release pin 380, the first and second recesses 440 and 460 of the first horizontal release pin 380 are aligned with respect to each other, wherein the first horizontal release pin 380 has a flat region 480 extending between the first and second recesses 440 and 460 of the first horizontal release pin 380.

6. The quick release gas block securing system of claim 3, wherein the first horizontal release pin 380 defines a first end 400 and a second end 420, the first end 400 thereof defining a head 410, the first horizontal release pin 380 having a first recess.

7. The quick release gas block securing system of claim 3, wherein the first horizontal release pin 380 defines a first end 400 and a second end 420, the first end 400 thereof defining a head 410, the first horizontal release pin 380 having at least one recess.

8. A quick release gas block securing system, comprising:

a rifle barrel 100 comprising a longitudinal axis 120, an upper exterior surface 130, a lower exterior surface 140, the upper exterior surface having a blind hole 143 therein for receiving an index pin 145 and a gas port 147 for directing propellant gas into a gas block 180, the lower exterior surface 140 having an external recess 160, the external recess 160 being transverse with respect to the lower exterior surface 140 of the rifle barrel 100;

wherein the gas block 180 comprises a gas block longitudinal axis 200, an upper section 220 and a lower section 240, the upper section 220 having a cylindrical cavity 230 for receiving a distal end 250 of a gas nozzle 260, the gas nozzle 260 is held securely in place by a gas nozzle securing pin 270 extending into a vertical bore 275 itself extending through a top 290 of the gas block 180 into a through bore 295 in the distal end 250 of the gas nozzle 260;

wherein the lower section 240 of gas bock 180 comprises a horizontal through bore 310 of sufficient diameter to receive the rifle barrel 100, the through bore 310 having an internal upper surface 315 and a gas propellant passage 325 leading from the internal upper surface 315 for directing propellant gas received from gas port 147 of the rifle barrel 100 through the upper section 220 to and through the gas nozzle 260 to an expansion chamber 330 and thence to an operating rod mechanism 332, a slot 312 is located in the internal upper surface 315 at the proximal end of gas block 180, the slot 312 is sized to accommodate index pin 145, wherein the lower section 240 of the gas block 180 further comprises a first horizontal bore 340 at a perpendicular angle with respect to the gas block longitudinal axis 200, wherein the first horizontal bore 340 is aligned and in direct communication with the recess 160 in the lower exterior surface 140 of the rifle barrel 100, wherein the recess 160 in the lower exterior surface 140 of the rifle barrel 100 extends at least part way along an upper side 360 of the first horizontal bore 340, a first horizontal release pin 380 is dimensioned to slidably engage the first horizontal bore 340, the first horizontal release pin 380 having a first end 400 and a second end 420, the first end 400 thereof defining a head 410, the first horizontal release pin 380 having a first recess 440 and a second recess 460 respectively located proximate to the first and second ends 400 and 420 of the first horizontal release pin 380, the first and second recesses 440 and 460 of the first horizontal release pin 380 are aligned with respect to each other, wherein the first horizontal release pin 380 has a flat region 480 extending between the first and second recesses 440 and 460 of the first horizontal release pin 380, wherein upon full insertion of the first release pin 380 in the first horizontal bore 340 the first horizontal release pin 380 engages with the recess 160 in the lower exterior surface 140 of the rifle barrel 100, wherein the lower section 240 of the gas block 180 has a second horizontal bore 500 and a second horizontal release pin 520 located inside the second horizontal bore 500, the second horizontal bore 500 and the second horizontal release pin 520 are perpendicular to the first horizontal bore 340 and in contact therewith, the second horizontal bore 500 being parallel with respect to the longitudinal axis 200 of the gas block 180, whereupon full insertion of the first horizontal release pin 380 into the first horizontal bore 340 the first recess 440 of the first horizontal release pin 380 is manually alignable with the respect to the second horizontal bore 500 and the second horizontal release pin 520 therein, and whereupon during normal use the first horizontal release pin 380 is movable between a first and a second position inside the first horizontal bore 340, wherein at the first position the first recess 440 of the first horizontal release pin 380 is secured by a first end 540 of the second horizontal release pin 520 such that the first horizontal release pin 380 engages with the recess 160 in the lower exterior surface 140 of the rifle barrel 100 thereby securing the gas block 180, the gas nozzle 260 attached thereto, to the rifle barrel 100, and at the second position the second recess 460 of the first horizontal release pin 380 is secured by the first end 540 of the second horizontal release pin 520 such that the first horizontal release pin 380 does not engage with the recess 160 in the lower exterior surface 140 of the rifle barrel 100 thereby releasing the gas block 180 and the gas nozzle 260 attached thereto from the rifle barrel 100.

9. The quick release gas block securing system of claim 8, wherein the second horizontal release pin 520 defines a second end 560, the second end 560 defines a set screw 580.

10. The quick release gas block securing system of claim 8, wherein the second horizontal release pin 520 defines a second end 560, the second end 560 defines a set screw 580, wherein the set screw 580 encloses a spring 600, wherein the spring 600 biases the second horizontal release pin 520 to engage the first recess 440 of first horizontal release pin 380 or the second recess 460 of the first horizontal release pin 380.

* * * * *